US010061246B2

(12) United States Patent
Nishi

(10) Patent No.: US 10,061,246 B2
(45) Date of Patent: Aug. 28, 2018

(54) IMAGE FORMING DEVICE AND PROGRAM FOR SUPPRESSING GENERATION OF BLANK PORTIONS ON CONTINUOUS PAPER

(71) Applicant: KONICA MINOLTA, INC., Chiyoda-ku, Tokyo (JP)

(72) Inventor: Youichirou Nishi, Hino (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/343,630

(22) Filed: Nov. 4, 2016

(65) Prior Publication Data

US 2017/0139361 A1 May 18, 2017

(30) Foreign Application Priority Data

Nov. 18, 2015 (JP) ..... 2015-225286

(51) Int. Cl.
*G03G 15/00* (2006.01)

(52) U.S. Cl.
CPC ..... *G03G 15/5012* (2013.01)

(58) Field of Classification Search
CPC ..... G03G 15/5012
See application file for complete search history.

(56) References Cited

U.S. PATENT DOCUMENTS 7,079,794 B2 * 7/2006 Forbes, II ..... G03G 15/0844 399/257
7,085,506 B2 * 8/2006 Forbes, II ..... G03G 15/0844 399/257
7,324,769 B2 * 1/2008 Yamaoka ..... G03G 15/0121 399/49
7,773,896 B2 * 8/2010 Yagawara ..... G03G 15/5041 399/46
8,724,142 B2 * 5/2014 Sato ..... G06F 3/1203 358/1.15

(Continued)

FOREIGN PATENT DOCUMENTS

JP 2005-196057 A 7/2005
JP 2006091538 A * 4/2006

(Continued)

OTHER PUBLICATIONS

Machine translation of JP2006091538.*

(Continued)

*Primary Examiner* — David Bolduc
(74) *Attorney, Agent, or Firm* — Buchanan Ingersoll & Rooney PC

(57) ABSTRACT

An image forming device includes: an image forming unit configured to form a plurality of images on continuous paper based on a job; an image pattern creation unit configured to interrupt execution of the job and create an image pattern for consuming toner; a determination unit configured to determine necessity of creating the image pattern based on coverages of the images included in the job; and a calculation unit configured to, when the determination unit determines that it is necessary to create the image pattern, calculate a conveyance distance or a conveyance time of the continuous paper until creation of the image pattern, as interruption timing.

22 Claims, 6 Drawing Sheets

(56) References Cited

U.S. PATENT DOCUMENTS 8,770,698 B2 * 7/2014 Ochiai ..... B41J 3/60 347/104
2006/0029405 A1 * 2/2006 Tanaka ..... G03G 15/553 399/27
2006/0062617 A1 * 3/2006 Yamasaki ..... G03G 15/5062 399/384
2006/0188307 A1 * 8/2006 Inui ..... G03G 15/652 399/396
2006/0204299 A1 * 9/2006 Tanimoto ..... G03G 15/6567 399/384
2007/0036575 A1 * 2/2007 Hamano ..... G03G 15/50 399/82
2007/0212086 A1 * 9/2007 Yagawara ..... G03G 15/0131 399/49
2008/0034996 A1 * 2/2008 Yamamoto ..... G03G 15/652 101/225
2008/0317486 A1 * 12/2008 Monma ..... G03G 15/0131 399/45
2009/0016785 A1 * 1/2009 Haan ..... G03G 15/0131 399/301
2009/0110420 A1 * 4/2009 Sheflin ..... G03G 15/5041 399/49
2009/0257760 A1 * 10/2009 Kaneda ..... G03G 15/5012 399/18
2010/0247124 A1 * 9/2010 Aoki ..... G03G 15/161 399/49
2010/0329756 A1 * 12/2010 Mizes ..... G03G 15/0131 399/364
2011/0052221 A1 * 3/2011 Hirobe ..... G03G 15/0877 399/27
2011/0211009 A1 * 9/2011 Fujinaga ..... B41J 29/393 347/16
2011/0211857 A1 * 9/2011 Mikami ..... G03G 15/5029 399/82
2012/0014703 A1 * 1/2012 Karasawa ..... G03G 15/238 399/49
2012/0020689 A1 * 1/2012 Inoue ..... G03G 15/238 399/68
2012/0027442 A1 * 2/2012 Torimaru ..... G03G 15/161 399/44
2012/0051823 A1 * 3/2012 Hoshino ..... B41J 11/70 400/582
2012/0070160 A1 * 3/2012 Aoki ..... G03G 15/5029 399/16
2012/0081715 A1 * 4/2012 Takano ..... G06K 15/16 358/1.5
2014/0064747 A1 * 3/2014 Numazu ..... G03G 15/5062 399/19
2014/0125982 A1 * 5/2014 Takemura ..... G03G 15/5062 356/421
2015/0071671 A1 * 3/2015 Kiuchi ..... G03G 15/5062 399/72
2015/0160599 A1 * 6/2015 Kamihara ..... G03G 15/1605 399/27
2015/0168902 A1 * 6/2015 Sasami ..... G03G 15/5054 399/72
2015/0248097 A1 * 9/2015 Nose ..... G03G 15/556 399/27
2016/0078331 A1 * 3/2016 Ikeda ..... B41J 15/00 358/1.14
2016/0085195 A1 * 3/2016 Uchida ..... G03G 15/5095 399/45
2016/0109840 A1 * 4/2016 Oonishi ..... G03G 15/652 399/45
2016/0124343 A1 * 5/2016 Sakurai ..... G03G 15/105 399/58
2016/0170357 A1 * 6/2016 Saito ..... G03G 15/0844 399/27
2016/0170358 A1 * 6/2016 Fukai ..... G03G 15/556 399/27
2016/0291517 A1 * 10/2016 Kamei ..... G03G 15/556
2017/0185022 A1 * 6/2017 Tsuda ..... G03G 15/50

FOREIGN PATENT DOCUMENTS

JP 2012-051671 A 3/2012
JP 2014-021369 A 2/2014
JP 2014-149487 8/2014
JP 2015-161897 A 9/2015
JP 2016-091538 A 5/2016

OTHER PUBLICATIONS

Machine translation of JP2005196057.*
Machine translation of JP2014021369.*
Office Action (Notice of Reasons for Rejection) dated Sep. 12, 2017, by the Japanese Patent Office in corresponding Japanese Patent Application No. 2015-225286, and an English Translation of the Office Action. (11 pages).

* cited by examiner

IMAGE FORMING DEVICE AND PROGRAM FOR SUPPRESSING GENERATION OF BLANK PORTIONS ON CONTINUOUS PAPER

The entire disclosure of Japanese Patent Application No. 2015-225286 filed on Nov. 18, 2015 including description, claims, drawings, and abstract are incorporated herein by reference in its entirety.

BACKGROUND OF THE INVENTION

Field of the Invention

The present invention relates to an image forming device and a program.

Description of the Related Art

In an electrophotographic image forming system, when the toner in the developing device is deteriorated, a problem such as degradation of image quality or toner spilling is caused. As such, the toner in the developing device is replaced in a certain amount or more when a certain period of time passes (which is called toner refreshing).

For example, a technology has been proposed in which when image formation of low coverage images is continued with use of cut sheets of paper, an image pattern named refresh band is created between sheets to forcibly consume toner to thereby replace the toner in the developing device (for example, see JP 2014-149487 A).

However, when attempting to apply the aforementioned technology to continuous paper, as a refresh band is created at an unexpected portion between images on the sheets, it is not preferable. Furthermore, in a configuration having a separation mechanism for separating continuous paper from a transfer unit, it is possible to create a refresh band in a state where the transfer unit is separated from the continuous paper. However, an interruption process or the like is involved, whereby blank portions (gaps between images) are generated at a plurality of locations on the continuous paper, which lowers the productivity.

As such, a fixed upper limit value (e.g., 300 m) of a paper passing distance of continuous paper may be set, and when the upper limit value is reached, refresh bands may be created collectively on the continuous paper.

As a result, it is expected to prevent blank portions from being generated at a plurality of locations and to suppress lowering of the productivity. Moreover, in the case where a job has a length exceeding the fixed upper limit value, it is possible to present, to the user, a fact that blank portions will be generated due to interruption during a job, and an option of cancelling the job.

However, even when an upper limit value is reached, there is a case where a job can be completed without need of creating a refresh band and without any blank portions, depending on the coverages of the images constituting a job. Even in such a situation, with a configuration in which a refresh band is created whenever the upper limit value is reached, a user may cancel the job uselessly, which leads to lowering of the productivity.

SUMMARY OF THE INVENTION

The present invention has been made in view of such problems. An object of the present invention is to provide an image forming device and a program capable of suppressing generation of blank portions on continuous paper due to toner refreshing and suppressing lowering of the productivity.

To achieve the abovementioned object, according to an aspect, an image forming device reflecting one aspect of the present invention comprises: an image forming unit configured to form a plurality of images on continuous paper based on a job; an image pattern creation unit configured to interrupt execution of the job and create an image pattern for consuming toner; a determination unit configured to determine necessity of creating the image pattern based on coverages of the images included in the job; and a calculation unit configured to, when the determination unit determines that it is necessary to create the image pattern, calculate a conveyance distance or a conveyance time of the continuous paper until creation of the image pattern, as interruption timing.

To achieve the abovementioned object, according to an aspect, a non-transitory recording medium storing a computer readable program reflecting one aspect of the present invention causes a computer of an image forming device to execute: a process of forming a plurality of images on continuous paper based on a job; a process of interrupting execution of the job and creating an image pattern for consuming toner; a process of determining necessity of creating the image pattern based on coverages of the images included in the job; and a process of, when it is determined that it is necessary to create the image pattern, calculating a conveyance distance or a conveyance time of the continuous paper until creation of the image pattern, as interruption timing.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

First, a configuration of an image forming system of the present embodiment will be described.

Figure 1:
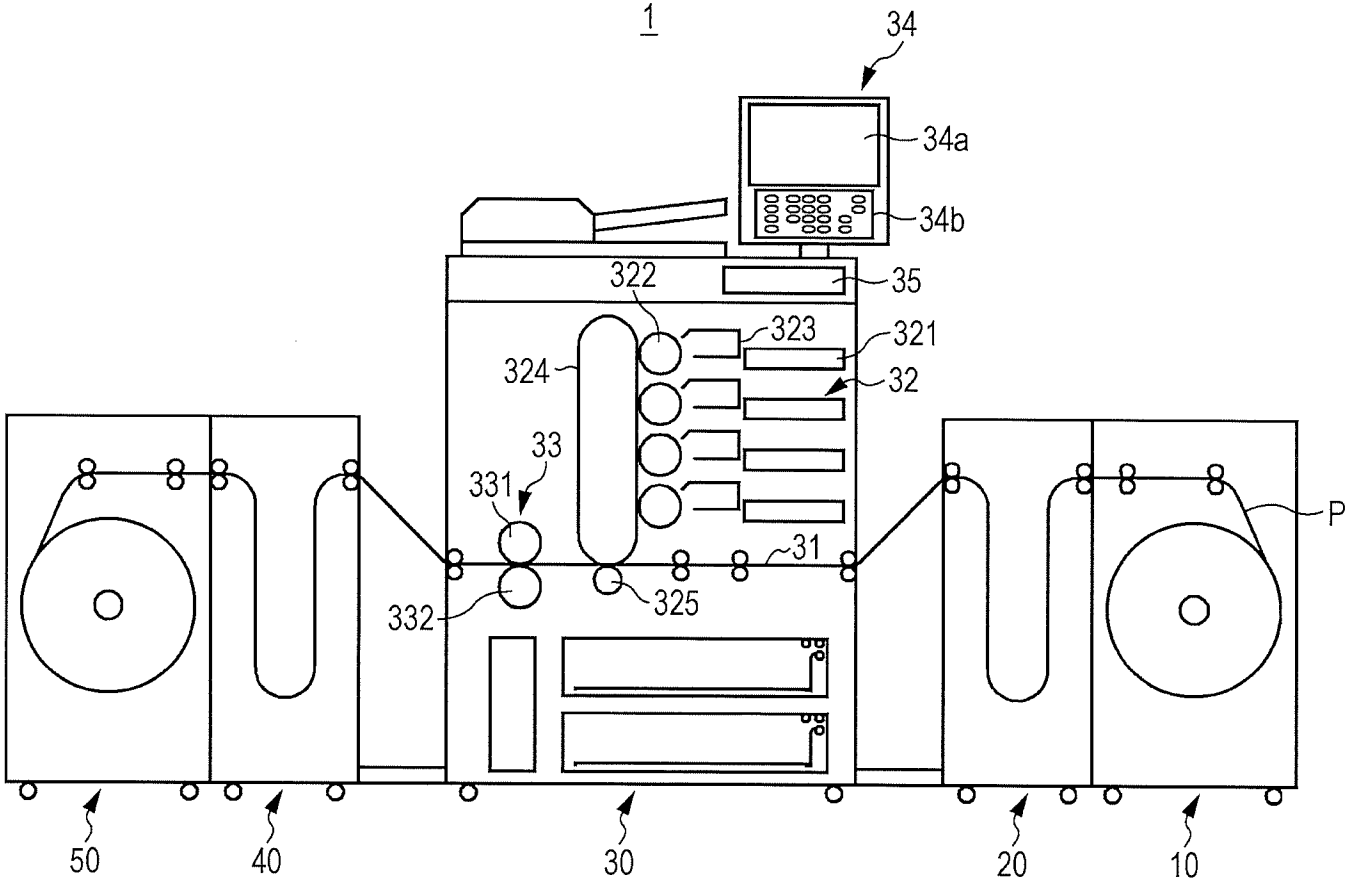
FIG. 1 is a diagram illustrating an exemplary schematic configuration of an image forming system according to an embodiment of the present invention.

FIG. 1 is a diagram illustrating an exemplary schematic configuration of an image forming system 1.

The image forming system 1 is a system that uses continuous paper (rolled paper) P as a recording medium and forms an image on the continuous paper P.

As illustrated in FIG. 1, the image forming system 1 includes a paper feeder 10, a paper feed adjuster 20, an image forming device 30, a winding adjuster 40, and a winding device 50 which are connected with each other from the upstream side along a direction of conveying the continuous paper P.

The paper feeder 10 is a device for feeding the continuous paper P to the image forming device 30. As illustrated in FIG. 1, in the casing of the paper feeder 10, rolled continuous paper P winds about a support shaft and is held rotatably, for example. In the paper feeder 10, the continuous paper P winding about the support shaft is conveyed to the outside at a constant speed via a plurality of rollers (a delivering roller and a paper feeding roller, for example). It should be noted that the continuous paper P is not necessarily held in a rolled state in the paper feeder 10. It may be held in a folded state. Furthermore, while FIG. 1 illustrates only one unit of continuous paper P, a plurality of units of continuous paper may be held.

The paper feed adjuster 20 is disposed downstream of the paper feeder 10 and upstream of the image forming device 30 in the direction of conveying the continuous paper P. The paper feed adjuster 20 is a device for conveying the continuous paper P, conveyed from the paper feeder 10, to the image forming device 30. In order to absorb a speed difference between the speed of conveying the continuous paper P in the paper feeder 10 and the speed of conveying the continuous paper P in the image forming device 30, the paper feed adjuster 20 holds the continuous paper P by slacking it as illustrated in FIG. 1 so as to adjust feeding of the continuous paper P to the image forming device 30.

The image forming device 30 is a device having a function of forming an image on the continuous paper P. The image forming device 30 is disposed downstream of the paper feed adjuster 20 and upstream of the winding adjuster 40 in the direction of conveying the continuous paper P.

The winding adjuster 40 is disposed downstream of the image forming device 30 and upstream of the winding device 50 in the direction of conveying the continuous paper P. The winding adjuster 40 is a device for conveying the continuous paper P, conveyed from the image forming device 30, to the winding device 50. In order to absorb a speed difference between the speed of conveying the continuous paper P in the image forming device 30 and the speed of conveying the continuous paper P in the winding device 50, the winding adjuster 40 holds the continuous paper P by slacking it as illustrated in FIG. 1 so as to adjust ejection of the continuous paper P from the image forming device 30.

The winding device 50 is a device for winding the continuous paper P conveyed from the image forming device 30 via the winding adjuster 40. As illustrated in FIG. 1, in the casing of the winding device 50, the continuous paper P winds about the support shaft and is held in a rolled state, for example. As such, in the winding device 50, the continuous paper P conveyed from the winding adjuster 40 is wound by a support shaft at a constant speed via a plurality of rollers (a delivering roller and a sheet ejection roller, for example). It should be noted that in the winding device 50, the continuous paper P is not necessarily in a rolled state and it may be cut into pages.

Next, a configuration of the image forming device 30 will be described in detail.

Figure 2:
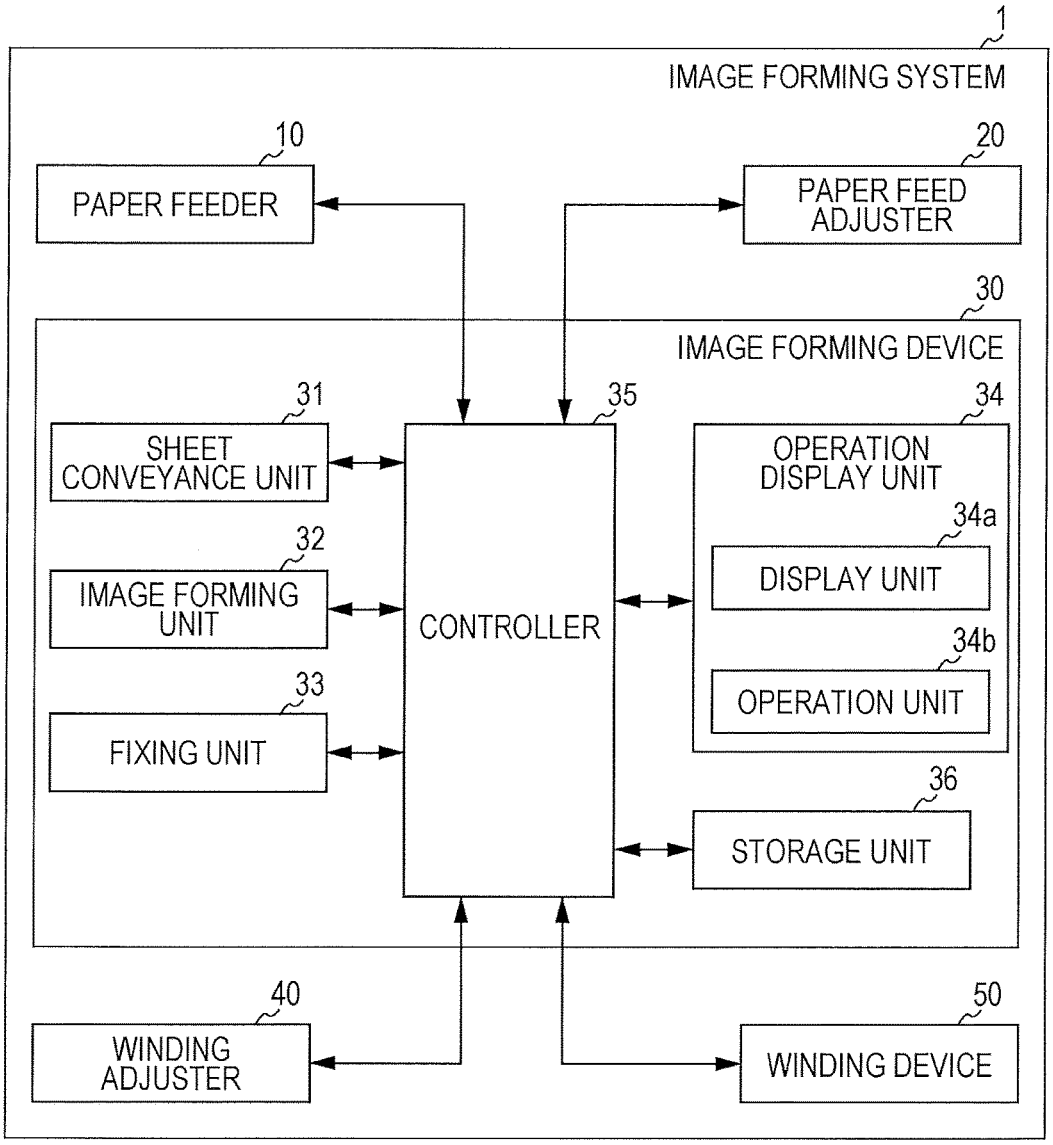
FIG. 2 is a functional block diagram illustrating a controlling configuration of an image forming device according to the embodiment of the present invention.

FIG. 2 is a functional block diagram illustrating a controlling configuration of the image forming device 30.

As illustrated in FIG. 2, the image forming device 30 includes a sheet conveyance unit 31, an image forming unit 32, a fixing unit 33, an operation display unit (notification unit, selection unit) 34, a controller (image pattern creation unit, acquisition unit, determination unit, calculation unit) 35, and a storage unit 36.

The sheet conveyance unit 31 is a mechanism for conveying the continuous paper P inside the image forming device 30. For example, the continuous paper P, conveyed from the paper feed adjuster 20, is conveyed to the image forming unit 32 via a plurality of rollers, and the continuous paper P passing through the image forming unit 32 and the fixing unit 33 is conveyed to the winding adjuster 40.

The image forming unit 32 is configured to form an image on the continuous paper P based on an image formation job transmitted from an external device, for example.

As an image forming system by the image forming unit 32, an electrophotographic system is adopted. Specifically, the image forming unit 32 includes four sets of units each including a light exposure unit 321, a photoreceptor 322, a developing unit 323, an intermediate transfer belt 324, and a transfer roller 325, corresponding to color components of Y, M, C, and K, respectively (see FIG. 1).

The light exposure unit 321 irradiates the photoreceptor 322 to be charged with laser light and allows it to be exposed to light, to form an electrostatic latent image on the photoreceptor 322. The developing unit 323 supplies toner of a predetermined color (any of Y, M, C, and K) by the developing roller charged on the exposed photoreceptor 322 to thereby develop the electrostatic latent image formed on the photoreceptor 322.

Images (monochrome images) formed of the toners of Y, M, C, and K on the four photoreceptors 322 corresponding to Y, M, C, and K are sequentially transferred from the respective photoreceptors 322 to the intermediate transfer belt 324 in an overlapping manner. As a result, a toner image containing color components of Y, M, C, and K is formed on the intermediate transfer belt 324. The intermediate transfer belt 324 is an endless belt wound on a plurality of conveyance rollers, and rotates according to rotation of the respective conveyance rollers. Then, by applying a bias of a reverse polarity to that of the toner to the transfer roller 325, the toner image formed on the intermediate transfer belt 324 is transferred on the continuous paper P.

The fixing unit 33 fixes the toner image transferred on the continuous paper P.

For example, the fixing unit 33 includes a pair of rollers consisting of a heating roller 331 and a pressure roller 332 for sandwiching the continuous paper P (see FIG. 1).

The heating roller 331 is heated to a predetermined temperature by a heater that is a heating source.

The pressure roller 332 is energized toward the heating roller 331 by an elastic member not shown. The continuous paper P, on which the toner image is transferred, passes through a nip portion between the heating roller 331 and the pressure roller 332, whereby it is applied with heat and pressure. As a result, the toner image melts and is fixed The operation display unit 34 includes a display screen, and also includes a display unit **34*a* for displaying various types of information on the screen and an operation unit 34*b*** used for inputting various instructions by a user.

The controller 35 includes a central processing unit (CPU) and a random access memory (RAM), for example. The CPU of the controller 35 reads various programs such as a system program and a process program stored in the storage unit 36 and develops them on the RAM, and executes various processes such as an image formation process and a toner refreshing process in accordance with the developed programs (the details thereof will be described below).

The storage unit 36 includes a hard disk drive (HDD) and a semiconductor nonvolatile memory, for example.

In the storage unit 36, various programs such as a system program and a process program to be executed by the controller 35 and data required for executing such programs are stored.

For example, in the storage unit 36, setting information required for executing the toner refreshing process is stored.

It should be noted that in the present embodiment, the controller 35 collectively controls the entire image forming system 1 as illustrated in FIG. 2. However, it is also possible that each of the paper feeder 10, the paper feed adjuster 20, the winding adjuster 40, and the winding device 50 includes a controller.

Furthermore, the image forming device 30 may be a multi-function peripheral (MFP) having a copying function, a scanning function, a facsimile machine function, and the like, in addition to a printing function.

Next, operation of the image forming system 1 in the present embodiment will be described.

In the image forming system 1, an image formation process to form an image on the continuous paper P based on an image formation job (hereinafter simply referred to as a "job") is performed.

Furthermore, in the image forming system 1, in order to prevent a problem of degradation of the image quality or the like due to deteriorated toner in the developing unit 323 of the image forming unit 32, a toner refreshing process is also performed. In the toner refreshing process, the toner in the developing unit 323 is forcibly consumed to replace the toner in accordance with the coverage (coverage rate) of an image to be formed in the image formation process.

Figure 3:
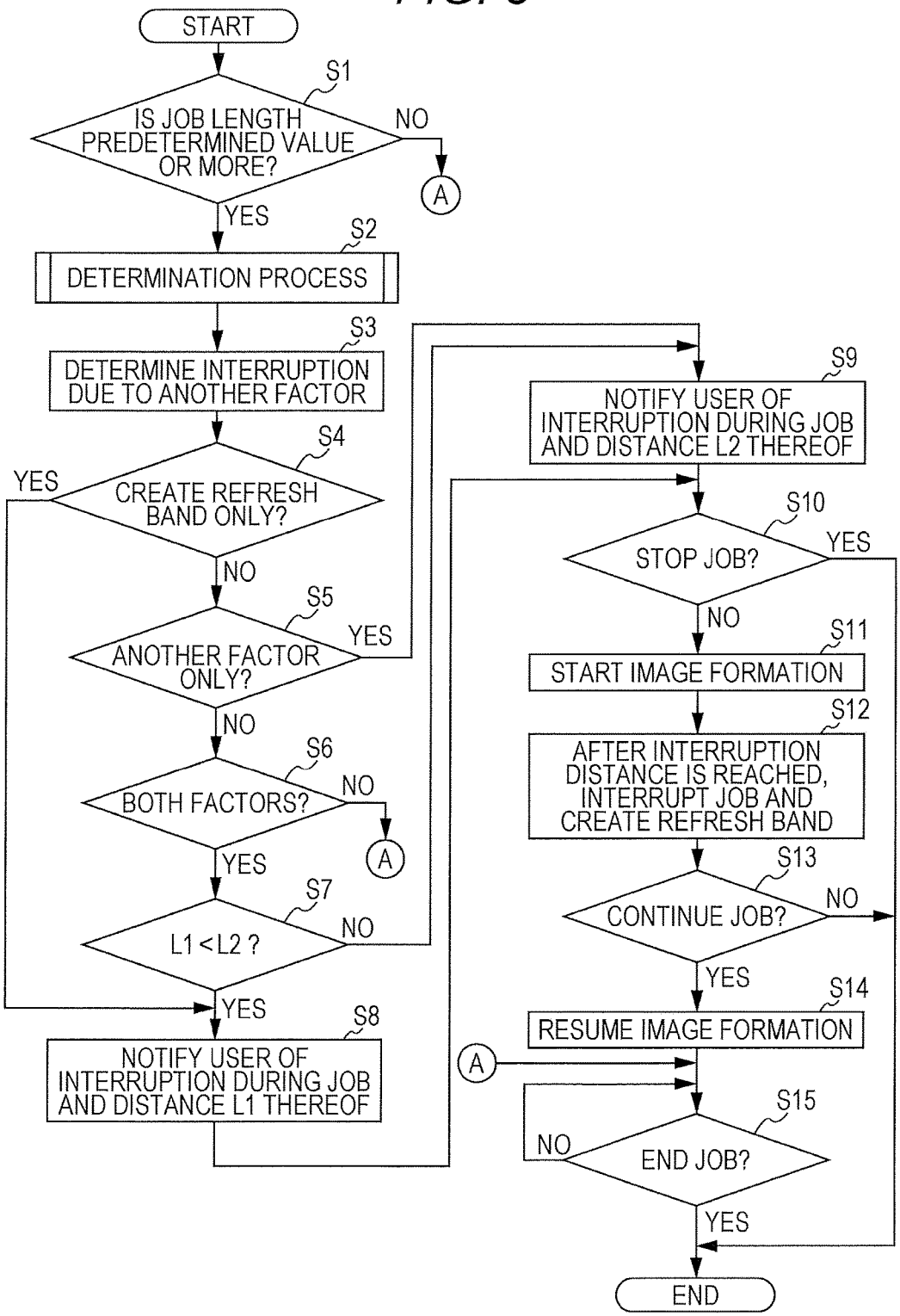
FIG. 3 is a flowchart illustrating a procedure of a toner refreshing process in the embodiment of the present invention.

Hereinafter, the toner refreshing process will be described in detail. FIG. 3 is a flowchart illustrating the procedure of the toner refreshing process.

As illustrated in FIG. 3, first, at step S1, the controller 35 determines whether the length of a job (job length) to be executed is a preset given value (e.g., 300 m) or more.

The length of a job is a length of the continuous paper P to be used for the job. It is also possible to use the time required for executing the job or the number of image data sets constituting the job, instead of the job length.

When the job length is less than the predetermined value (step S1: NO), the process proceeds to step S15 described below.

On the other hand, when the job length is the predetermined value or more (step S1: YES), at subsequent step S2, the controller 35 performs a determination process to determine whether or not it is necessary to create an image pattern (refresh band) for forcibly consuming the toner in the developing unit 323 from the coverages of the images constituting the job, and to determine the timing of creating a refresh band in the case of creating a refresh band.

Figure 4:
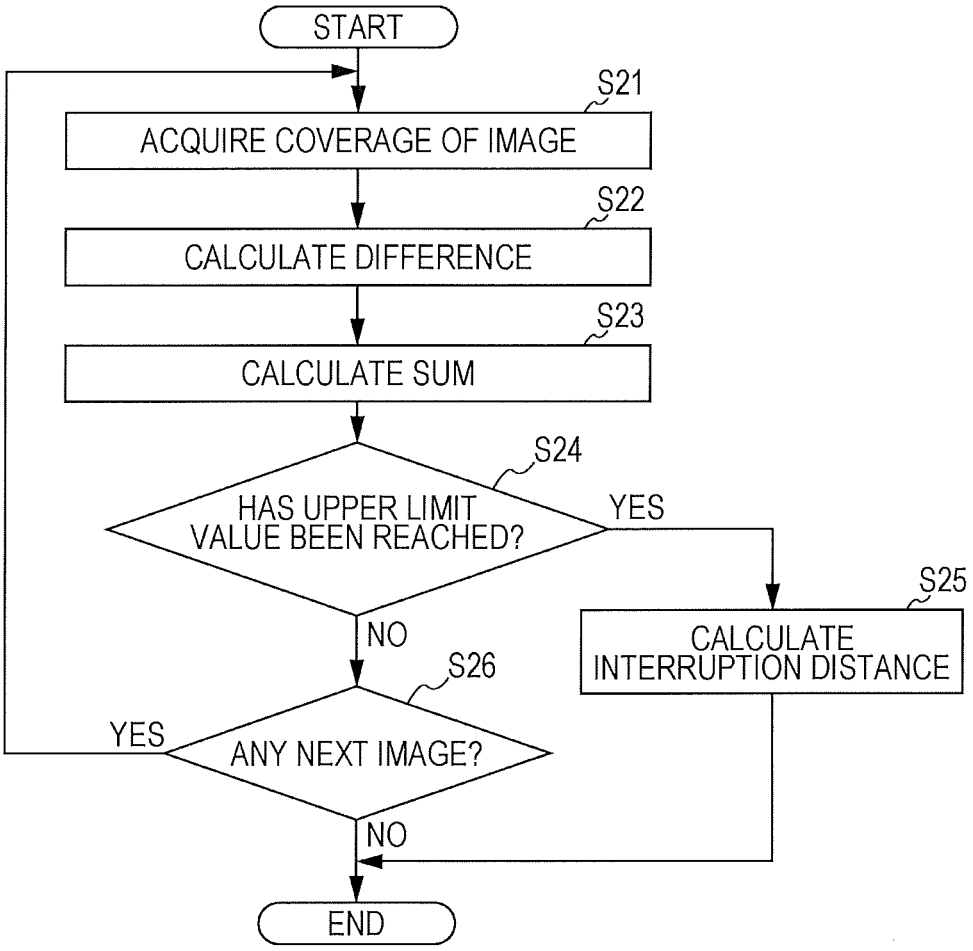
FIG. 4 is a flowchart illustrating a procedure of a determination process in the embodiment of the present invention.

FIG. 4 is a flowchart illustrating the procedure of such a determination process.

As illustrated in FIG. 4, first, at step S21, the controller 35 selects an image which comes first in the order of image formation among images which are included in the job and in which a coverage thereof has not been acquired, and acquires the coverage of such an image.

In this case, it is assumed that the coverages of the images included in the job are acquired when trial printing of the job is performed and are stored in the storage unit 36.

Next, at step S22, the controller 35 compares the coverage of the acquired image with a preset reference value (A %) of the coverage for one pixel, and calculates a difference (Dif(n)). The reference value (A %) is set mechanically to a level at which no effect such as image quality degradation occurs. The reference value can be changed arbitrarily by a user. In that case, the changed reference value is stored in the storage unit 36 as setting information.

Next, at step S23, the controller 35 adds the calculated difference to a value obtained by sequentially adding the differences calculated from the previous images to thereby calculate a sum (Sum(n)).

It should be noted that at steps S21 to S23, when there are identical images in a plurality of images included in the job, the coverage of the first image of the identical images may apply to the other images of the identical images. For example, when there are continuous identical images in the images included in the job, for example, the coverage of the first image may be applied to the second and subsequent image. In this context, identical images include images determined to be almost identical within a reference range, besides completely identical images.

Next, at step S24, the controller 35 compares the calculated sum with an upper limit value (B %) of the sum of the coverages less than the preset reference value (A %), and determines whether or not the calculated sum reaches the upper limit value. The upper limit value (B %) is set mechanically to a level at which no effect such as image quality degradation occurs. The upper limit value can be changed arbitrarily by a user. In that case, the upper limit value is stored in the storage unit 36 as setting information.

Then, when the sum reaches the upper limit value (that is, in the case where it is determined that creation of a refresh band is necessary) (step S24: YES), at subsequent step S25, the controller 35 calculates a conveyance distance (interruption distance L1) of the continuous paper P until before formation of an image in which the upper limit value is reached, and ends the process. For example, in the case where an image in which the upper limit value is reached is an image (N+1), in order to create a refresh band before forming the image (N+1), the controller 35 calculates a conveyance distance of the continuous paper P until formation of the previous image (N) which is an image immediately before the image in which the upper limit value is reached.

It should be noted that the conveyance distance of the continuous paper P can be obtained from the image length, the image intervals, and the number of images.

Instead of the conveyance distance (interruption distance L1) of the continuous paper P, it is also possible to calculate a conveyance time (interruption time) of the continuous paper P. The conveyance time of the continuous paper P can be obtained from the conveyance distance and the conveyance speed of the continuous paper P.

Instead of the conveyance distance (interruption distance L1) of the continuous paper P or the conveyance time (interruption time) of the continuous paper P, it is also possible to use the number of images to be formed on the continuous paper P.

When the sum does not reach the upper limit value (that is, in the case where it is determined that creation of a refresh band is not necessary yet) (step S24: NO), at subsequent step S26, the controller 35 determines whether or not there is any image for which a coverage has not been acquired, and if there is such an image (step S26: YES), returns to step S21 and repeats the subsequent processing, while if there is no such an image (step S26: NO), ends the process.

It should be noted that the aforementioned determination process is performed for each of the colors of Y, M, C, and K. Then, it is configured that the shortest conveyance distance of the continuous paper P until creation of a refresh band is selected as an actual interruption distance L1.

Furthermore, as described above, while it has been described that the present embodiment has a configuration in which the reference value (A %) of a coverage is set for each image, it is possible to set a reference value of a coverage for a predetermined conveyance distance, conveyance time, or the like. In that case, an image corresponding to the conveyance distance or the conveyance time is acquired and compared with the reference value.

Returning to FIG. 3, next, at step S3, the controller 35 determines whether or not it is necessary to interrupt image formation due to a factor other than creation of a refresh band.

A factor other than creation of a refresh band may be timing of executing an image correction process, an image quality stabilizing process, toner supply, or the like. Furthermore, in the case of interrupting image formation due to such a factor, a conveyance distance (interruption distance L2) of the continuous paper P until interruption is set mechanically to a level at which an effect such as image quality degradation does not occur. The conveyance distance can be changed arbitrarily by a user. In that case, the conveyance distance is stored in the storage unit 36 as setting information.

Next, at step S4, the controller 35 determines whether or not the factor of interrupting image formation is only creation of a refresh band, from the results of steps S2 and S3.

When the factor of interrupting image formation is only creation of a refresh band (step S4: YES), the processing proceeds to step S8 described below.

On the other hand, when the factor of interrupting image formation is not only formation of a refresh band (step S4: NO), at subsequent step S5, the controller 35 determines whether or not the factor of interrupting image formation is only a factor other than creation of a refresh band.

When the factor of interrupting image formation is only a factor other than creation of a refresh band (step S5: YES), the processing proceeds to step S9 described below.

On the other hand, when the factor of interrupting image formation it not only a factor other than creation of a refresh band (step S5: NO), at subsequent step S6, the controller 35 determines whether or not the factor of interrupting image formation includes both creation of a refresh band and a factor other than creation of a refresh band.

When the factor of interrupting image formation does not include both creation of a refresh band and a factor other than creation of a refresh band (step S6: NO), the controller 35 proceeds to step S15 described below.

On the other hand, when the factor of interrupting image formation includes both creation of a refresh band and a factor other than creation of a refresh band (step S6: YES), at subsequent step S7, the controller 35 determines whether or not the interruption distance L1 is shorter than the interruption distance L2.

When the interruption distance L1 is shorter than the interruption distance L2 (step S7: YES), the controller 35 proceeds to step S8 described below.

On the other hand, when the interruption distance L1 is not shorter than the interruption distance L2 (step S7: NO), the controller 35 proceeds to step S9 described below.

Next, at step S8, the controller 35 notifies a user of a fact that interruption occurs during execution of image formation and a conveyance distance (interruption distance L1) of the continuous paper P until interruption.

Furthermore, at step S9, the controller 35 notifies the user of a fact that interruption occurs during execution of image formation and a conveyance distance (interruption distance L2) of the continuous paper P until interruption.

Figure 5:
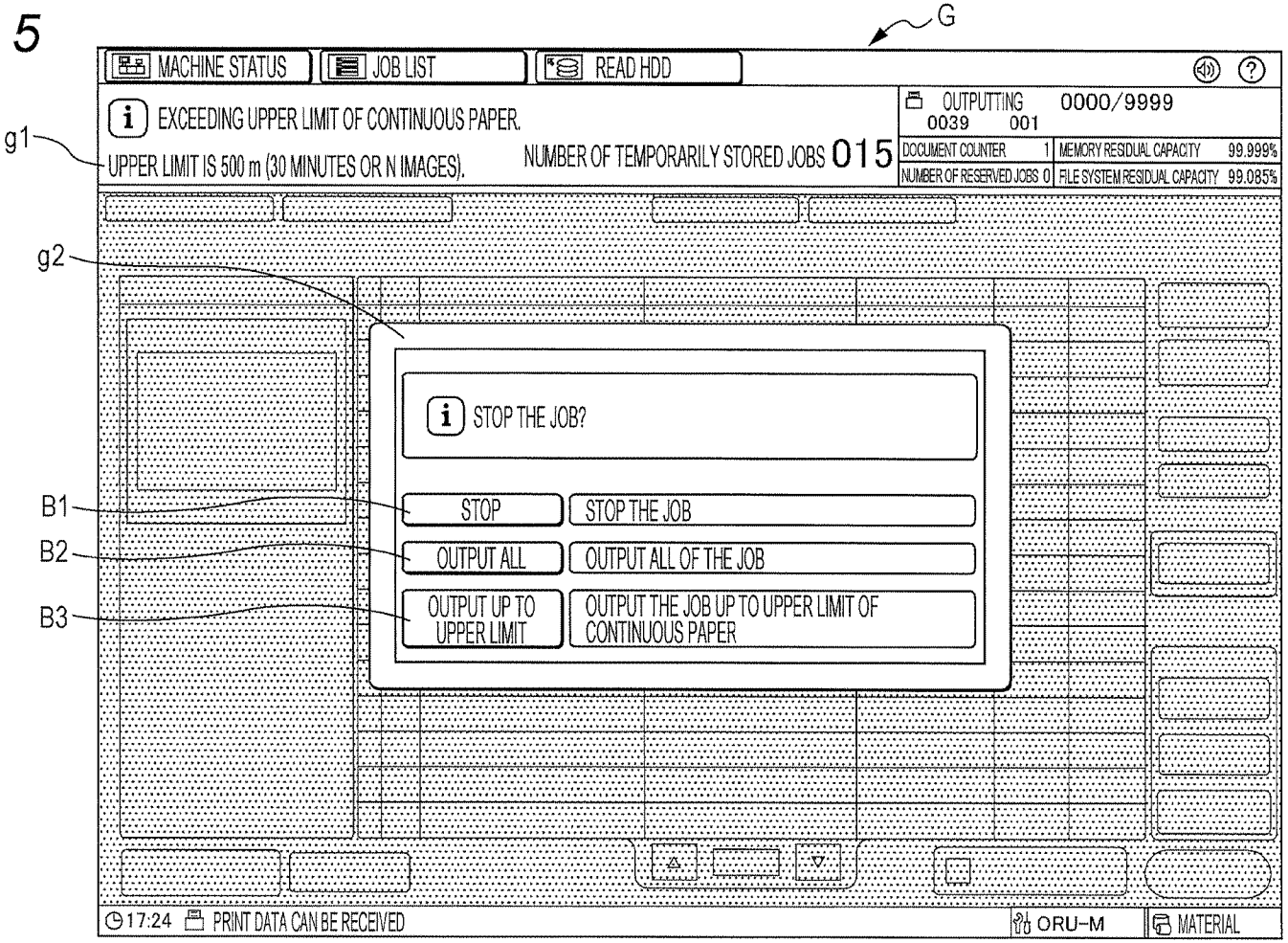
FIG. 5 illustrates an example of a notification screen displayed on a display unit of an operation display unit.

FIG. 5 illustrates an example of a notification screen G displayed on the display unit 34*a* of the operation display unit 34.

The notification screen G displays a message g1 notifying the user of the interruption distance L1 or the interruption distance L2.

The notification screen G also displays a selection box g2 for allowing the user to select whether or not to stop the job. The selection box g2 includes a "stop" button B1 to stop the job, "output all" button B2 to output the entire job, and an "output up to upper limit" button B3 to output the job until interruption (until creation of a refresh band) and stop outputting thereafter.

Then, at step S10, the controller 35 determines whether or not to stop the job according to whether or not the "stop" button B1 is operated by the user.

When determining to stop the job (when the "stop" button B1 is operated by the user) (step S10: YES), the controller 35 ends the process.

On the other hand, when determining to continue the job (when the "output all" button B2 or the "output up to upper limit" button B3 is operated by the user) (step S10: NO), at subsequent step S11, the controller 35 starts the image formation process.

Then, at step S12, when the interruption distance L1 or the interruption distance L2 is reached, the controller 35 interrupts the image formation process and creates a refresh band.

Then, at step S13, the controller 35 determines whether or not to resume the image formation process according to whether or not the "output all" button B2 is operated by the user.

When determining not to resume the image formation process (when the "output up to upper limit" button B3 is operated by the user) (step S13: NO), the controller 35 ends the process.

On the other hand, when determining to resume the image formation process (when the "output all" button B2 is operated by the user) (step S13: YES), at subsequent step S14, the controller 35 resumes the image formation process.

Then, at step S15, the controller 35 determines whether or not the job is finished, and when the job is not finished (step S15: NO), repeats step S15.

On the other hand, when the job is finished (step S15: YES), the controller 35 ends the process.

Figure 6:
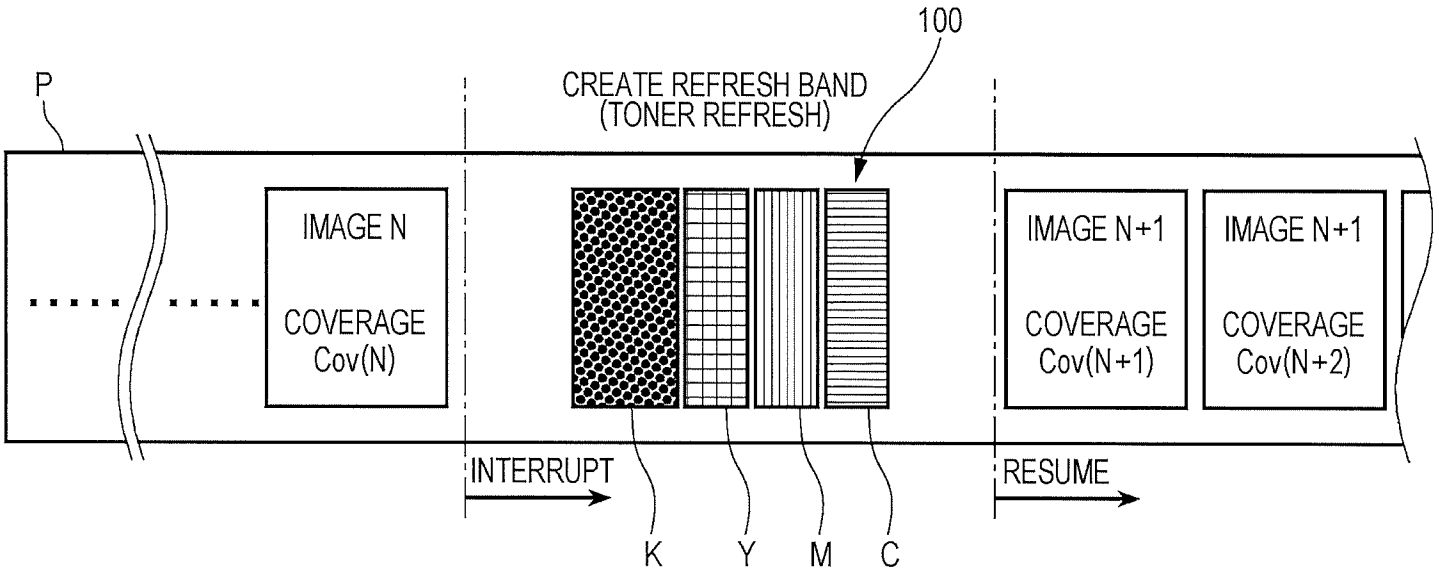
FIG. 6 is a schematic diagram illustrating a state where a refresh band is created on continuous paper.

FIG. 6 is a schematic diagram illustrating a state of the continuous paper P in the case where the image formation process is interrupted, a refresh band is created, and then the image formation process is resumed.

FIG. 6 illustrates an example in which the image formation process is interrupted when image formation is performed up to an image N on the continuous paper P, and a refresh band 100 is formed, and then the image formation process is resumed and an image N+1 and an image N+2 are formed on the continuous paper P.

Although not shown, if the image formation process is finished when the refresh band 100 is formed, the image N+1 and the image N+2 in FIG. 6 are not formed on the continuous paper P.

In the determination process illustrated in FIG. 4, the refresh band 100 is created at the timing in accordance with a color having the shortest conveyance distance of the continuous paper P until creation of the refresh band 100. As such, as illustrated in FIG. 6, image patterns of the respective colors of Y, M, C, and K are formed. FIG. 6 illustrates an example in which the refresh band 100 is created in accordance with "K".

As described above, according to the present embodiment, in the image forming device 30 including the image forming unit 32 that forms a plurality of images on continuous paper based on a job and the controller 35 that controls the image forming unit 32 to create a refresh band for consuming the toner by interrupting execution of the job, the controller 35 determines the necessity of a refresh band based on the coverages of the images included in the job, and when determining that a refresh band is necessary, the controller 35 calculates a conveyance distance or a conveyance time up to a refresh band as interruption timing.

Accordingly, a refresh band is created only when it is necessary to create a refresh band according to the coverages of the images included in a job. Thus, it is possible to suppress generation of blank portions on the continuous paper P due to toner refreshing, and to suppress lowering of the productivity.

Furthermore, according to the present embodiment, the controller 35 sequentially compares the coverages of the images included in a job with a preset reference value, and sequentially adds the shortages with respect to the reference value. When the sum reaches a preset upper limit value, the controller 35 determines that it is necessary to create a refresh band, and calculates a conveyance distance or a conveyance time of the continuous paper P until before creating the image in which the upper limit value is reached, as interruption timing.

Thus, it is possible to create a refresh band at appropriate timing, according to the coverages of the images included in the job at appropriate timing.

Furthermore, according to the present embodiment, when there are identical images in the images included in a job, the controller 35 applies the coverage of the first image of the identical images to the other images of the identical images.

Thus, a determination process can be simplified.

Furthermore, the present embodiment includes the operation display unit 34 for notifying a user of a fact that interruption occurs during execution of a job and the interruption timing, when it is determined that creation of a refresh band is necessary.

Thus, it is possible to present, to a user, appropriate information that interruption occurs during execution of a job.

Furthermore, the present embodiment includes the operation display unit 34 that, when it is determined that creation of a refresh band is necessary, allows a user to select to stop the job, execute the job until a refresh band is created, or execute the entire job.

Thus, a user is able to select a level of execution of the job in the case where an interruption occurs due to toner refreshing.

Furthermore, according to the present embodiment, the controller 35 determines whether or not there is any factor other than creation of a refresh band as a factor of interruption during execution of a job. When there is another factor, the controller 35 compares the timing of interruption due to the other factor and the timing of interruption for creating a refresh band, and if the timing of interruption due to the other factor is shorter than the timing of interruption for creating a refresh band, the operation display unit 34 notifies a user of the timing of interruption due to the other factor.

Thus, it is possible to present, to a user, appropriate information that interruption will be made due to a factor other than toner refreshing during execution of a job.

Furthermore, according to the present embodiment, the controller 35 does not create a refresh band when the job length is less than a preset given value.

Thus, the determination process can be omitted depending on the job length.

Furthermore, the present embodiment includes a plurality of image forming units 32 that create images of different colors from each other, and the controller 35 determines the necessity of creating a refresh band for each color and calculates interruption timing for each color. Then, the controller 35 creates refresh bands of all colors in accordance with the smallest value among the calculated interruption timing.

Thus, toner refreshing of a plurality of colors can be performed efficiently.

Furthermore, according to the present embodiment, the controller 35 acquires coverages of the images of a job before execution of the job, stores them in the storage unit 36, and based on the stored coverages, determines the necessity of creating a refresh band at the time of image formation of the first set in the job.

Thus, it is possible to present, to a user, whether or not creation of a refresh band is performed during a job, before execution of the job.

Furthermore, according to the present embodiment, when trial printing of a job is performed by the image forming unit 32, the controller 35 acquires coverages at the time of trial printing of the job performed by the image forming unit 32.

Thus, it is possible to acquire information of coverages required for the determination process at the time of trial printing before execution of the regular job.

In the aforementioned embodiment, description has been given on an exemplary configuration in which a determination process is executed before execution of a regular job (at the time of trial printing), and a user is notified of the necessity of a refresh band and interruption timing according to a result of the determination process. However, it is also possible to have a configuration in which the determination process is performed during execution of the regular job (during execution of the job at the time of image formation of a first set) and the coverages are acquired at that time.

This means that during execution of a job at the time of image formation of a first set, the coverages of images included in the job are acquired, and they are stored in the storage unit 36. Then, at the time of image formation of the second set or after, the necessity of a refresh band and the interruption timing, according to a result of the determination process, is notified to the user.

In that case, at the time of image formation of the first set in the job, interruption timing is notified with a preset given value.

Furthermore, while a configuration in which a refresh band is formed on the continuous paper P has been described in the aforementioned embodiment, it is also possible to have a configuration including a separation mechanism for separating the continuous paper P from a transfer unit and no refresh band is formed on the continuous paper P (the continuous paper P includes a blank portion in a predetermined section).

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming device comprising:

an image forming unit configured to form a plurality of images on continuous paper based on a job;

an image pattern creation unit configured to interrupt execution of the job and create an image pattern for consuming toner;

a determination unit configured to determine necessity of creating the image pattern based on coverages of the images included in the job;

a calculation unit configured to, when the determination unit determines that it is necessary to create the image pattern, calculate a conveyance distance or a conveyance time of the continuous paper until creation of the image pattern, as interruption timing; and a notification unit configured to notify a user of a fact that interruption occurs during execution of the job and the interruption timing, in a case where the determination unit determines that it is necessary to create the image pattern.

2. The image forming device according to claim 1, wherein the determination unit sequentially compares the coverages of the images included in the job with a preset reference value, sequentially adds shortages with respect to the reference value, and when a sum thereof reaches a preset upper limit value, the determination unit determines that it is necessary to create the image pattern; and the calculation unit calculates, as the interruption timing, a conveyance distance or a conveyance time of the continuous paper until before formation of an image in which the upper limit value is reached.

3. The image forming device according to claim 2, wherein when there are identical images in the images included in the job, the determination unit applies a coverage of a first image of the identical images to other images of the identical images.

4. The image forming device according to claim 1, further comprising:

a selection unit configured to allow the user to select to stop the job, execute the job until creation of the image pattern, or execute the entire job, in the case where the determination unit determines that it is necessary to create the image pattern.

5. The image forming device according to claim 1, wherein the determination unit determines whether or not there is an other factor other than creation of the image pattern as a factor of interruption during execution of the job, wherein the other factor is timing of executing an image correction process, an image quality stabilizing process, or a toner supply;

when there is the other factor, the determination unit compares interruption timing due to the other factor with the interruption timing due to creation of the image pattern; and when the interruption timing due to the other factor is shorter than the interruption timing due to creation of the image pattern, the notification unit notifies the user of the interruption timing due to the other factor.

6. The image forming device according to claim 1, wherein when a job length is less than a preset given value, the image pattern creation unit does not create the image pattern.

7. The image forming device according to claim 1, further comprising:

a plurality of the image forming units each configured to form an image of a different color, wherein the determination unit determines necessity of creating the image pattern for each color;

the calculation unit calculates the interruption timing for each color; and the image pattern creation unit creates the image patterns for all colors in accordance with a color having a smallest value among values of the interruption timing calculated by the calculation unit.

8. The image forming device according to claim 1, further comprising:

an acquisition unit configured to acquire a coverage of each of the images included in the job before execution of the job;

a storage unit configured to store the coverage acquired by the acquisition unit; and wherein the determination unit determines the necessity of creating the image pattern at a time of image formation of a first set of images in the job, based on the coverage stored in the storage unit.

9. The image forming device according to claim 8, wherein when the image forming unit performs trial printing of the job, the acquisition unit acquires the coverage at a time of the trial printing of the job by the image forming unit.

10. The image forming device according to claim 1, further comprising:

an acquisition unit configured to acquire a coverage of each of the images included in the job during execution of the job;

a storage unit configured to store the coverage acquired by the acquisition unit; and wherein the determination unit determines the necessity of creating the image pattern at a time of image formation of a second set of images in the job or after, based on the coverage stored in the storage unit.

11. The image forming device according to claim 10, further comprising a second notification unit configured to notify the user of a fact that interruption occurs during execution of the job and the interruption timing; and wherein the second notification unit notifies the user of the interruption timing with a preset given value at the time of image formation of a first set of images in the job.

12. A non-transitory recording medium storing a computer readable program for causing a computer of an image forming device to execute:

a process of forming a plurality of images on continuous paper based on a job;

a process of interrupting execution of the job and creating an image pattern for consuming toner;

a process of determining necessity of creating the image pattern based on coverages of the images included in the job;

a process of, when it is determined that it is necessary to create the image pattern, calculating a conveyance distance or a conveyance time of the continuous paper until creation of the image pattern, as interruption timing; and a process of notifying a user of a fact that interruption occurs during execution of the job and the interruption timing, in a case where it is determined that it is necessary to create the image pattern in the process of determining.

13. The non-transitory recording medium storing a computer readable program according to claim 12, wherein the process of determining includes sequentially comparing the coverages of the images included in the job with a preset reference value, sequentially adding shortages with respect to the reference value, and when a sum thereof reaches a preset upper limit value, determining that it is necessary to create the image pattern; and the process of calculating includes calculating, as the interruption timing, a conveyance distance or a conveyance time of the continuous paper until before formation of an image in which the upper limit value is reached.

14. The non-transitory recording medium storing a computer readable program according to claim 13, wherein the process of determining includes, when there are identical images in the images included in the job, applying a coverage of a first image of the identical images to other images of the identical images.

15. The non-transitory recording medium storing a computer readable program according to claim 12, the program further causing the computer to execute:

a process of allowing the user to select to stop the job, execute the job until creation of the image pattern, or execute the entire job, in the case where it is determined that it is necessary to create the image pattern in the process of determining.

16. The non-transitory recording medium storing a computer readable program according to claim 12, wherein the process of determining includes:

determining whether or not there is an other factor other than creation of the image pattern as a factor of interruption during execution of the job, wherein the other factor is timing of executing an image correction process, an image quality stabilizing process, or a toner supply;

when there is the other factor, comparing interruption timing due to the other factor with the interruption timing due to creation of the image pattern; and the process of notifying includes, when the interruption timing due to the other factor is shorter than the interruption timing due to creation of the image pattern, notifying the user of the interruption timing due to the other factor.

17. The non-transitory recording medium storing a computer readable program according to claim 12, wherein in the process of creating the image pattern, when a job length is less than a preset given value, the image pattern is not created.

18. The non-transitory recording medium storing a computer readable program according to claim 12, wherein the image forming device includes a plurality of image forming units each configured to form an image of a different color;

wherein the process of determining includes determining necessity of creating the image pattern for each color;

the process of calculating includes calculating the interruption timing for each color; and the process of creating the image pattern includes creating the image patterns for all colors in accordance with a color having a smallest value among values of the interruption timing calculated.

19. The non-transitory recording medium storing a computer readable program according to claim 12, the program further causing the computer to execute:

a process of acquiring a coverage of each of the images included in the job before execution of the job;

a process of storing the acquired coverage in a storage unit; and wherein the process of determining includes determining the necessity of creating the image pattern at a time of image formation of a first set of images in the job, based on the coverage stored in the storage unit.

20. The non-transitory recording medium storing a computer readable program according to claim 19, wherein when an image forming unit performs trial printing of the job, the process of acquiring includes acquiring the coverage at a time of the trial printing of the job by the image forming unit.

21. The non-transitory recording medium storing a computer readable program according to claim 12, the program further causing the computer to execute:

a process of acquiring a coverage of each of the images included in the job during execution of the job; and a process of storing the acquired coverage in a storage unit, wherein the process of determining includes determining the necessity of creating the image pattern at a time of image formation of a second set of images in the job or after, based on the coverage stored in the storage unit.

22. The non-transitory recording medium storing a computer readable program according to claim 21, the program further causing the computer to execute:

a process of notifying the user of a fact that interruption occurs during execution of the job and the interruption timing, wherein the process of notifying includes notifying the user of the interruption timing with a preset given value at the time of image formation of a first set of images in the job.

* * * * *